US007507143B2

(12) United States Patent
Yamada

(10) Patent No.: US 7,507,143 B2
(45) Date of Patent: Mar. 24, 2009

(54) TRUING METHOD FOR GRINDING WHEEL

(75) Inventor: Hirohisa Yamada, Yao (JP)

(73) Assignee: Koyo Machine Industries Co., Ltd., Osaka (JP)

( * ) Notice: Subject to any disclaimer, the term of this patent is extended or adjusted under 35 U.S.C. 154(b) by 0 days.

(21) Appl. No.: 11/474,390

(22) Filed: Jun. 26, 2006

(65) Prior Publication Data

US 2006/0237395 A1 Oct. 26, 2006

Related U.S. Application Data

(62) Division of application No. 10/468,680, filed as application No. PCT/JP01/11502 on Dec. 26, 2001, now Pat. No. 7,118,448.

(51) Int. Cl.
*B24B 49/00* (2006.01)
*B24B 51/00* (2006.01)

(52) U.S. Cl. ..... 451/5; 451/9; 451/10; 451/21; 451/56

(58) Field of Classification Search ..... 204/224 M, 204/217; 205/562, 658, 662, 663, 670, 672, 205/686; 219/69.15, 69.16, 69.17; 451/5, 451/8, 9, 10, 21, 22, 55, 56, 63, 72, 443
See application file for complete search history.

(56) References Cited

U.S. PATENT DOCUMENTS 4,622,449 A * 11/1986 Inoue ..... 219/69.11
5,194,124 A * 3/1993 Leary ..... 205/362
5,660,579 A * 8/1997 Nakayama et al. ..... 451/21
5,667,646 A * 9/1997 Tomotaki ..... 204/217
5,827,112 A * 10/1998 Ball ..... 451/21
5,910,040 A * 6/1999 Moriyasu et al. ..... 451/5
6,149,504 A * 11/2000 Ohmori et al. ..... 451/56
6,213,843 B1 * 4/2001 Kramer ..... 451/5
6,217,423 B1 * 4/2001 Ohmori et al. ..... 451/63
6,244,939 B1 * 6/2001 Ohmori et al. ..... 451/72
6,506,103 B1 * 1/2003 Ohmori et al. ..... 451/72
6,537,139 B2 * 3/2003 Ohmori ..... 451/56
6,547,648 B1 * 4/2003 Zhu et al. ..... 451/49

(Continued)

FOREIGN PATENT DOCUMENTS

JP 56-107842 A1 8/1981

(Continued)

OTHER PUBLICATIONS

International Search Report for PCT/JP01/11502 mailed on Apr. 23, 2002.

*Primary Examiner*—Timothy V Eley
(74) *Attorney, Agent, or Firm*—Cheng Law Group PLLC

(57) ABSTRACT

In a grinding machine comprising conductive grinding wheels, the invention presents a truing technique capable of truing grindstone surfaces of grinding wheels at high precision in a short time.

For example, in the case of truing flat annular grindstone surfaces (10*a*, 10*a*) of a pair of mutually opposite grinding wheels (1, 2) simultaneously, an electro-discharge truing electrode (20) is disposed oppositely between the grindstone surfaces (10*a*, 10*a*) of the two grinding wheels (1, 2), and while traversing relatively parallel along the both grindstone surfaces (10*a*, 10*a*), the grindstone surfaces (10*a*, 10*a*) are trued without making contact by the electro-discharge action between the electro-discharge truing electrode (20) and both grindstone surfaces (10*a*, 10*a*).

8 Claims, 14 Drawing Sheets

U.S. PATENT DOCUMENTS 6,566,623 B2 * 5/2003 McPhillips ..... 219/69.17
7,118,448 B2 * 10/2006 Yamada ..... 451/5

FOREIGN PATENT DOCUMENTS

JP 60-167661 U1 11/1985
JP 01-084963 U1 6/1989
JP 01-101762 U1 7/1989
JP 11221765 A 8/1999

* cited by examiner

TRUING METHOD FOR GRINDING WHEEL

CROSS REFERENCE TO RELATED APPLICATIONS

The present application is a Divisional Application of the patent application Ser. No. 10/468,680, filed Aug. 21, 2003, now U.S. Pat. No. 7,118,448 issued on Oct. 10, 2006, which is based on International Application No. PCT/JP01/11502 filed on Dec. 26, 2001, the entire contents of which are incorporated herein by reference.

TECHNICAL FIELD

The present invention relates to a truing method for grinding wheel, its truing device and grinding machine, and more particularly to an electro-discharge truing technology for truing the grinding wheel by making use of electro-discharge action in a grinding machine comprising the grinding wheel composed of conductive grindstone such as metal bond diamond grindstone.

BACKGROUND ART

Recently, as one of the latest precision machining techniques, the grinding technique using super-abrasive grains is highly noticed, and the diamond grindstone having diamond abrasive grains bound by resin or metal binding material is preferably used as an ideal grindstone for grinding rigid and brittle materials such as ceramics.

In the grinding machine using such super-abrasive grains as the grinding wheel, the grinding wheel was conventionally trued in the following manner.

For example, in the case of a vertical double disk surface grinding machine using metal bond diamond grinding wheel, its truing method is as shown in FIG. 14(*a*), in which a dressing stone b for truing is inserted between rotating grinding wheels a, a, and the bond (binding material) B of the grindstone surface in the grinding wheels a, a is shaved off by the abrasive grains released from the dressing stone b, and the grinding wheel is trued while dressing the abrasive grains A of the grindstone.

That is, the grinding wheel of super-abrasive grains of the surface grinding machine was trued by shaving off the bond B by using the released abrasive grains from the dressing stone b as the tool, which is known as the lapping technique.

The conventional truing method by such lapping method had the following problems, and its improvement has been demanded.

That is, in truing of grinding wheel by lapping technique, since the grinding wheel is trued by the lapping action of released abrasive grains, sharpness of abrasive grains deteriorates. It also took a long time when truing the grinding wheel by the lapping technique.

In particular, in truing the grinding wheel of double disk surface grinding machine, as shown in FIG. 14(*b*), if the balance of pressure applied to the dressing stone b is broken by the grinding wheels a, a in the truing process, the arm c supporting the dressing stone b is deflected, and accurate truing of grinding wheels a, a is difficult, and truing of high precision is not expected.

The invention is devised in the light of such problems in the prior art, and it is hence an object thereof to present a truing technique capable of truing the grinding wheel in a short time and at a high precision, in a grinding machine comprising a conductive grinding wheel, and a grinding machine operating on such grinding technique.

DISCLOSURE OF THE INVENTION

To achieve the object, the truing method for grinding wheel of the invention is a method of truing the grinding wheel in a grinding machine for grinding a work by a grinding wheel driven by rotation, and more specifically the grinding wheel is composed of a conductive grindstone having abrasive grains bound by a conductive binding material, and an electro-discharge truing electrode disposed oppositely to the grindstone surfaces of the conductive grinding wheel is traversed relatively along the grindstone surfaces of the grinding wheel, and the grindstone surfaces of the grinding wheel are trued by the electro-discharge action.

In a preferred embodiment, the gap dimension between the grindstone of the grinding wheel and electro-discharge truing electrode is controlled according to an electrical information of the electro-discharge position. The electrical information of the electro-discharge position is either the current flowing in the current feed circuit or the electro-discharge voltage at the electro-discharge position, and it is particularly suited to a case of truing a pair of grinding wheels disposed oppositely in the double disk surface grinding machine simultaneously by single truing means.

The truing device of grinding wheel of the invention is a device provided in a grinding machine for grinding a work by rotating grinding wheels, for truing the grinding wheel having abrasive grains bound by a conductive binding material, and it comprises an electro-discharge truing electrode disposed oppositely to the grindstone surfaces of the grinding wheel, current feeding means for feeding current to the grinding wheel and electro-discharge truing electrode, and truing electrode driving means for traversing the electro-discharge truing electrode parallel along the grindstone surfaces of the grinding wheel.

In a preferred embodiment, the electro-discharge truing electrode is a disk-shaped rotary electrode which is driven by rotation. In this case, the rotary electrode is preferred to have coolant supply means for injecting a coolant at its side, and air supply means for injecting air toward the gap between the grindstone of the grinding wheel and rotary electrode.

The grinding machine of the invention is a grinding machine for grinding a work by grinding wheels driven by rotation, and comprises grinding wheels composed of grindstones having abrasive grains bound by a conductive binding material, grinding wheel rotary driving means for rotating and driving the grinding wheels, grinding wheel infeed driving means for moving the grinding wheels in the infeed direction, electro-discharge truing means for truing the grinding wheels by electro-discharge action, and control means for controlling the grinding wheel rotary driving means, grinding wheel infeed driving means, and electro-discharge truing means synchronously with each other, and the electro-discharge truing means includes an electro-discharge truing electrode disposed oppositely to the grindstones of the grinding wheel, current feeding means for feeding current to the grinding wheel and electro-discharge truing electrode, and truing electrode driving means for traversing the electro-discharge truing electrode parallel along the grindstone surfaces of the grinding wheel.

In a preferred embodiment, the control means controls the grinding wheel rotary driving means, grinding wheel infeed driving means, and electro-discharge truing means synchronously with each other, so as to true the grinding wheel by electro-discharge action while traversing the electro-discharge truing electrode relatively along the grindstone surfaces of the grinding wheel.

The grinding wheels are cup wheels having a flat annular grindstone surface, and a pair of cup wheels are disposed oppositely to each other to construct a double disk surface grinding machine, and the both cup wheels are trued simultaneously by the single electro-discharge truing means. In this case, the control means controls the grinding wheel infeed driving means so as to adjust the gap dimension between the grindstone of the grinding wheel and electro-discharge truing electrode according to the result of detection from the current detecting means for detecting the current flowing in the current feeding circuit of the current feeding means.

When the invention is applied in a double disk surface grinding machine comprising a pair of opposite grinding wheels, for truing the mutually opposite cup wheels having a flat annular grindstone at the same time, the electro-discharge truing electrode is disposed oppositely between the annular grindstone surfaces of the two grinding wheels, and is relatively traversed parallel along the both annular grindstone surfaces of the two grinding wheels, so that the both annular grindstone surfaces of the two grinding wheels are trued by electro-discharge without making contact by the electro-discharge action between the electro-discharge truing electrode and both grinding wheels. As a result, the grinding wheels can be trued in a short time without spoiling the edge of abrasive grains of the grindstones.

Gap control, that is, the control of the gap dimension between the grindstone surfaces of the grinding wheels and the electro-discharge truing electrode is executed according to the electrical information of the electro-discharge position, and in the double disk surface grinding machine, in particular, the current flowing in the current feeding circuit of each grindstone of the grinding wheel or the electro-discharge voltage at the electro-discharge position is used as the electrical information of the electro-discharge position. Therefore, when truing the pair of grinding wheels disposed oppositely by one truing means simultaneously, gap control of high precision is realized between the grindstone surfaces of the grinding wheels and the electro-discharge truing electrode.

DETAILED DESCRIPTION OF THE PREFERRED EMBODIMENTS

Figure 1:
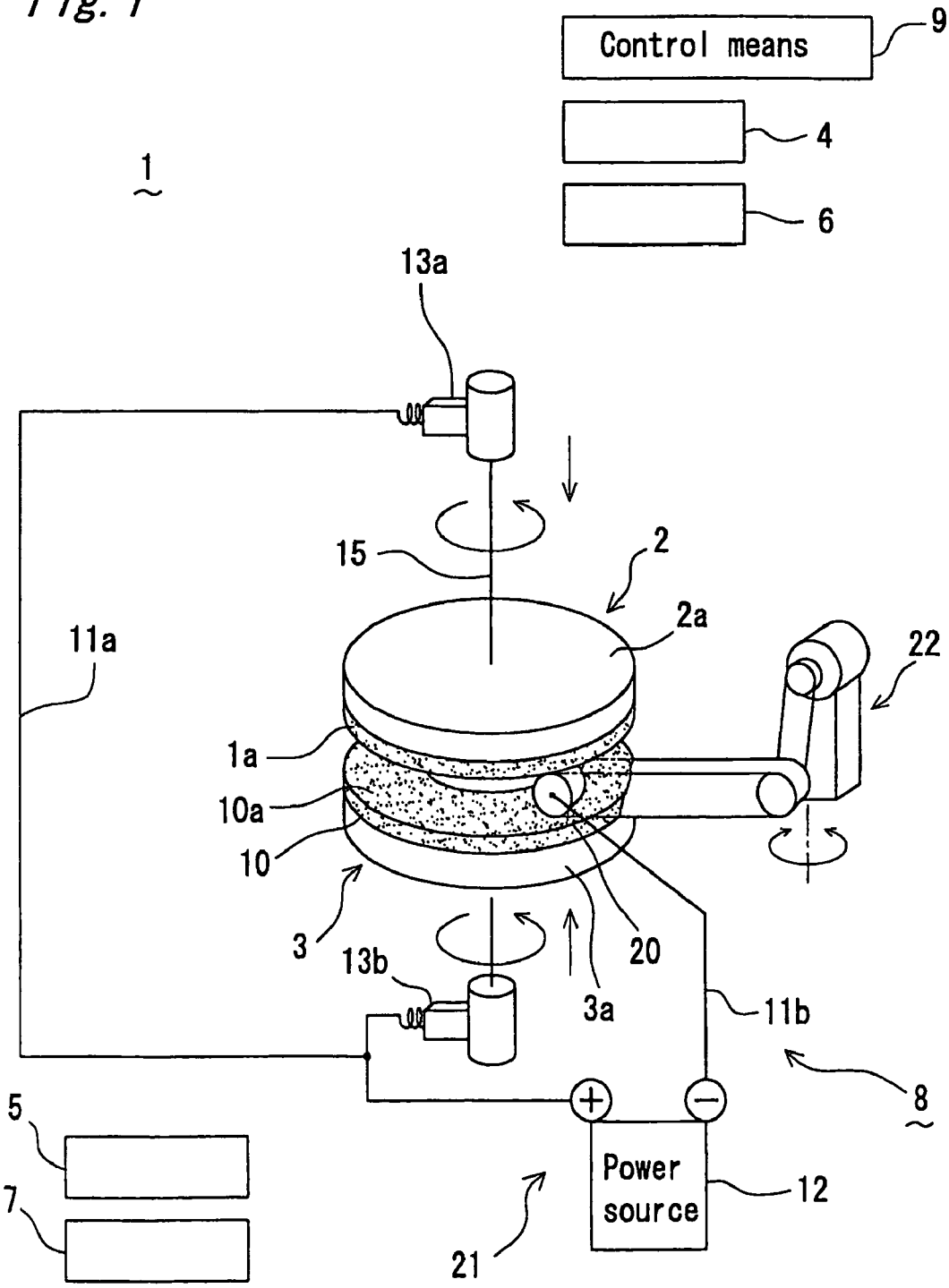
FIG. 1 is a perspective view of a partial block diagram showing a schematic configuration of truing device of conductive grinding wheel of a vertical double disk surface grinding machine in a preferred embodiment of the invention.

Preferred embodiments of the invention are described in detail below while referring to the accompanying drawings.

FIG. 1 through FIG. 13 show grinding machines according to the invention, and same reference numerals refer to same constituent members or elements throughout the drawings.

A grinding machine having a truing device according to preferred embodiments is shown in FIG. 1 to FIG. 10. This grinding machine 1 is specifically a vertical double disk surface grinding machine having a pair of grinding wheels 2, 3 disposed oppositely up and down coaxially, and mainly comprises the pair of grinding wheels 2, 3, grinding wheel rotary drive devices (grinding wheel rotary driving means) 4, 5, grinding wheel infeed drive devices (grinding wheel infeed driving means) 6, 7, an electro-discharge truing device (electro-discharge truing means) 8, and a control device (controlling means) 9.

The pair of grinding wheels 2, 3 are cup wheels of identical structure, and the end portion is a grindstone 10 having abrasive grains bound by a conductive binding material, and its end plane 10*a* is a flat annular grindstone surface.

The supporting structure of these grinding wheels 2, 3 is not specifically shown but is a known basic structure, and they are detachably mounted on the leading ends of rotary spindles 15, 16 disposed coaxially, and the grindstone surfaces 10*a*, 10*a* are disposed to be parallel to each other and opposite vertically.

The rotary spindles 15, 16 are rotatably supported on wheel heads of a device platform not shown, and are respectively coupled to the grinding wheel drive devices 4, 5 through a power transmission mechanism.

The grinding wheel drive devices 4, 5 are for rotating and driving the upper and lower grinding wheels 2, 3, and incorporate rotary drive sources such as motors (not shown).

The wheel heads for rotating and supporting the grinding wheels 2, 3 are elevatable in the vertical direction by means of a slide device, and are coupled respectively to the grinding wheel infeed drive devices 6, 7.

The grinding wheel infeed drive devices 6, 7 are for moving the upper and lower grinding wheels 2, 3 in the infeed direction (vertical direction in the shown example), and comprise feed mechanism (not shown) such as ball screw mechanism and infeed drive source (not shown) such as motor.

The both grinding wheels 2, 3 are composed of conductive grindstones 10 of which end portion has abrasive grains bound by a conductive binding material. Specifically, in these grinding wheels 2, 3, the grindstones 10 are integrally disposed in the end portions of the grinding wheel main bodies 2*a*, 3*a* made of conductive material.

Figure 9A:
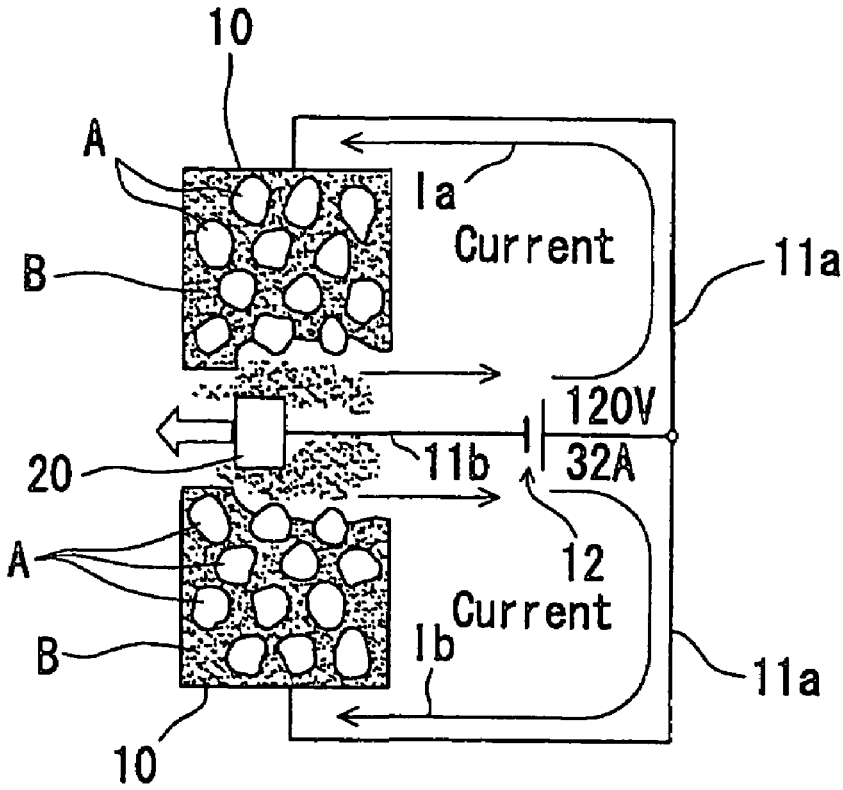
FIG. 9 is a diagram explaining the electro-discharge truing method of grinding wheel in the electro-discharge truing device, in which FIG. 9(*a*) is a model diagram showing the principle of electro-discharge truing in the double disk surface grinding machine, and FIG. 9(*b*) is a schematic sectional view showing a state of arm member of the electro-discharge truing electrode drive unit at the time of truing.
Figure 9B:
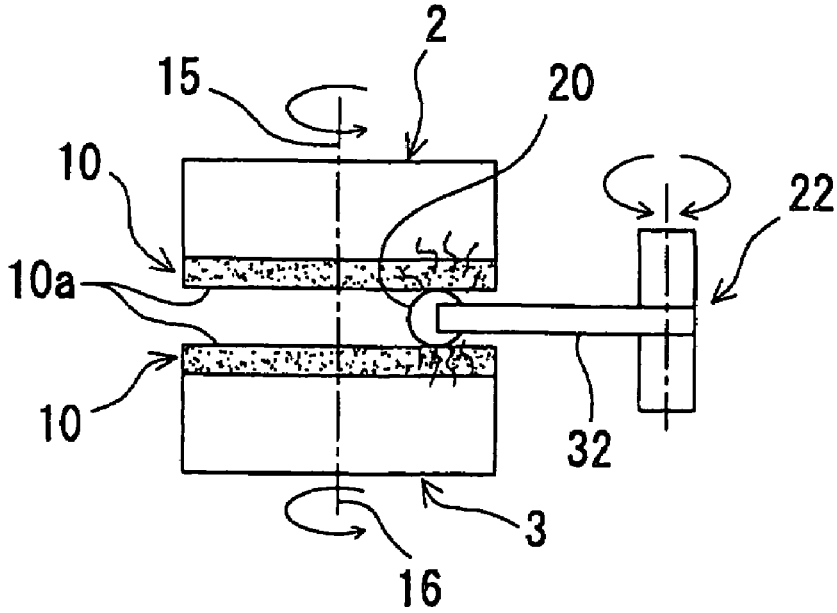

The grindstones 10 are made of abrasive materials A, specifically super-abrasive grains such as fine diamond abrasive grains and CBN (cubic boron nitride) abrasive grains, and these abrasive grains A, A, . . . are bound by a conductive binding material B. The conductive binding material B is preferably conductive metal bond, conductive resin bond containing conductive substance, or the like (properties of abrasive grains A and binding material B are shown in FIG. 9(*a*)).

These grinding wheels 2, 3 are electrically connected to the (+) pole of a direct-current power supply device 12 through a current feeding wire 11*a*. Specifically, as shown in FIG. 1, brush-like current feeders 13*a*, 13*b* are disposed at the leading ends of the current feeding wire 11*a*, and these current feeders 13*a*, 13*b* slide respectively on rotary spindles 15, 16 of the grinding wheels 2, 3, and are connected electrically.

In this configuration, through these rotary spindles 15, 16, direct-current power source can be supplied from the single direct-current power supply device 12 into the upper and lower grinding wheels 2, 3 (specifically grindstones 10), and the upper and lower grinding wheels 2, 3 are rotary electrodes of the (+) pole.

The electro-discharge truing device 8 is for truing the grindstones 10, 10 of the upper and lower grinding wheels 2, 3 by electro-discharge action, and mainly comprises an electro-discharge truing electrode 20, a current feed device (current feeding means) 21, and truing electrode drive device (truing electrode driving means) 22.

The electro-discharge truing electrode 20 is an electrode for electro-discharge truing of grindstone surfaces 10*a*, 10*a* of the upper and lower grinding wheels 2, 3, and is specifically a rotary electrode of a small narrow disk, and is disposed oppositely to the both grindstone surfaces 10*a*, 10*a*.

That is, the cylindrical outer circumference 20*a* of the electro-discharge truing electrode 20 is a cylindrical electrode surface opposite to the grindstone surfaces 10*a*, 10*a* of the grinding wheels 2, 3 forming the other rotary electrode, and the electro-discharge truing electrode 20 is designed to traverse parallel along the both grindstone surfaces 10*a*, 10*a* by means of truing electrode drive device 22 as explained below.

Further, the electro-discharge truing electrode 20 is electrically connected to the (−) pole of the direct-current power supply device 12 through the current feeding wire 11*b*, and is used as the electro-discharge truing electrode of the (−) pole.

The current feed device 21 is for feeding current to the grindstones 10, 10 of the grinding wheels 2, 3 and electro-discharge truing electrode 20, and mainly comprises an upper current feeding circuit 21*a* for the upper grinding wheel 2, a lower current feeding circuit 21*b* for the lower grinding wheel 3, and the direct-current power supply device 12 for supplying power source to these current feeding circuits 21*a*, 21*b*.

The upper current feeding circuit 21*a* forms a closed circuit of direct-current power source device 12, electro-discharge truing electrode 20, upper grinding wheel 2, and back to direct-current power supply device 12, and the lower current feeding circuit 21*b* forms a closed circuit of direct-current power source device 12, electro-discharge truing electrode 20, lower grinding wheel 3, and back to direct-current power supply device 12. These current feeding circuits 21*a*, 21*b* are provided with current detecting sensors 25*a*, 25*b* for detecting the current flowing in the circuits, and detection currents Ia, Ib of these current detecting sensors 25*a*, 25*b* are sent to the control device 9 respectively as mentioned below, thereby functioning as control factors for controlling and adjusting the gap dimension between the grindstone surface 10*a* and electro-discharge truing electrode 20.

Figure 2:
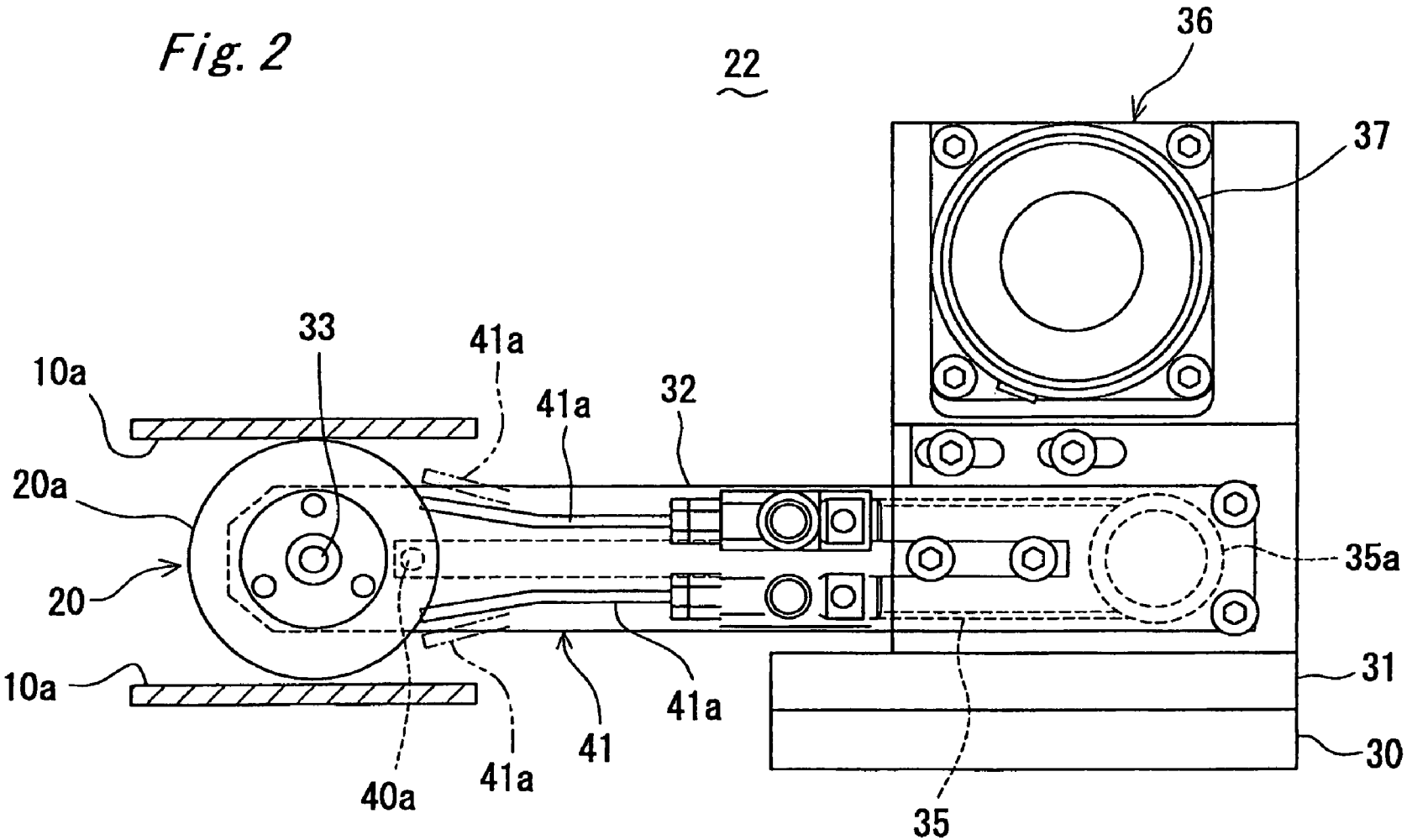
FIG. 2 is a side view of truing electrode drive unit in the truing device.
Figure 3:
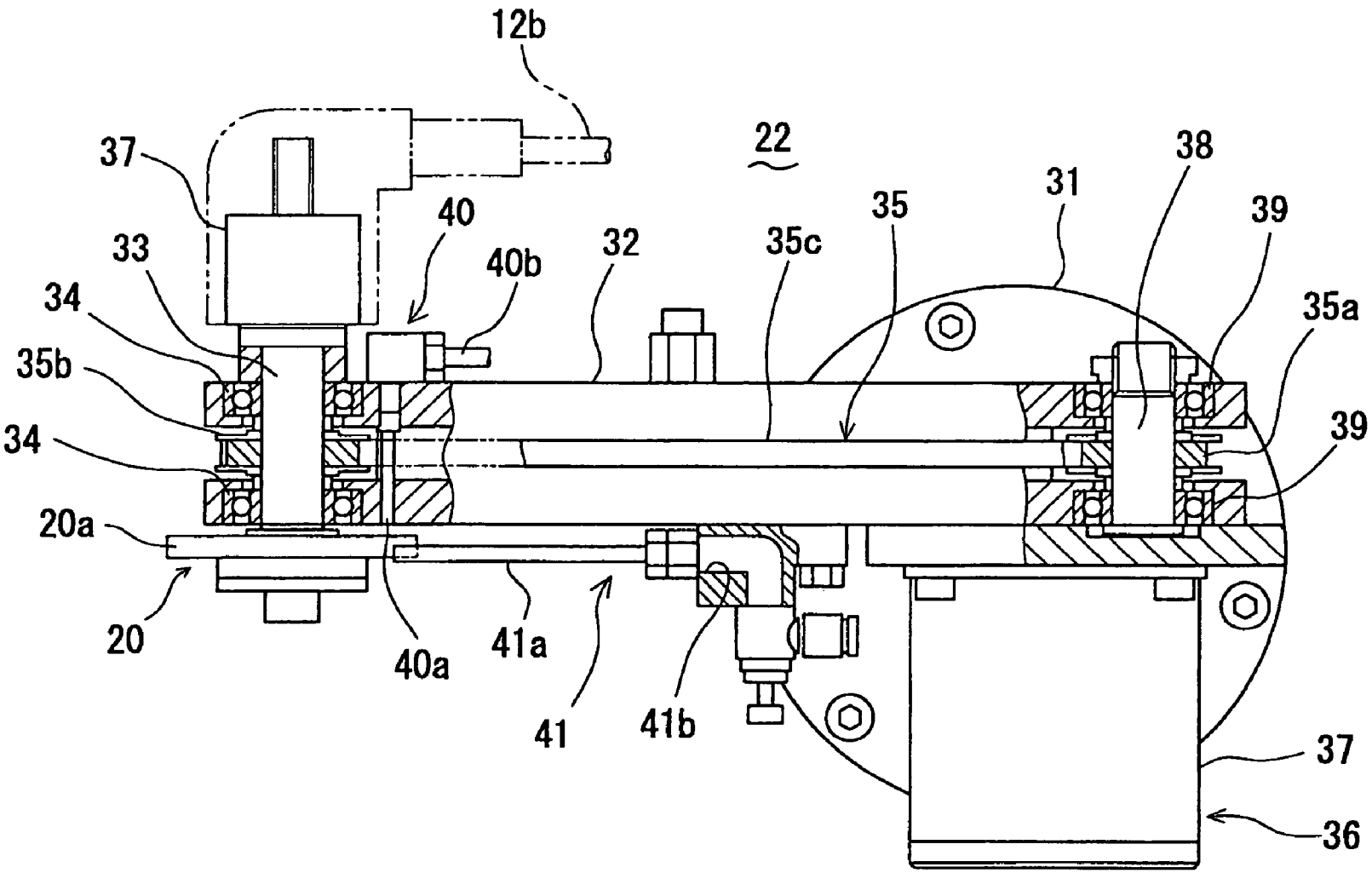
FIG. 3 is a plan view of the truing electrode drive unit.
Figure 4A:
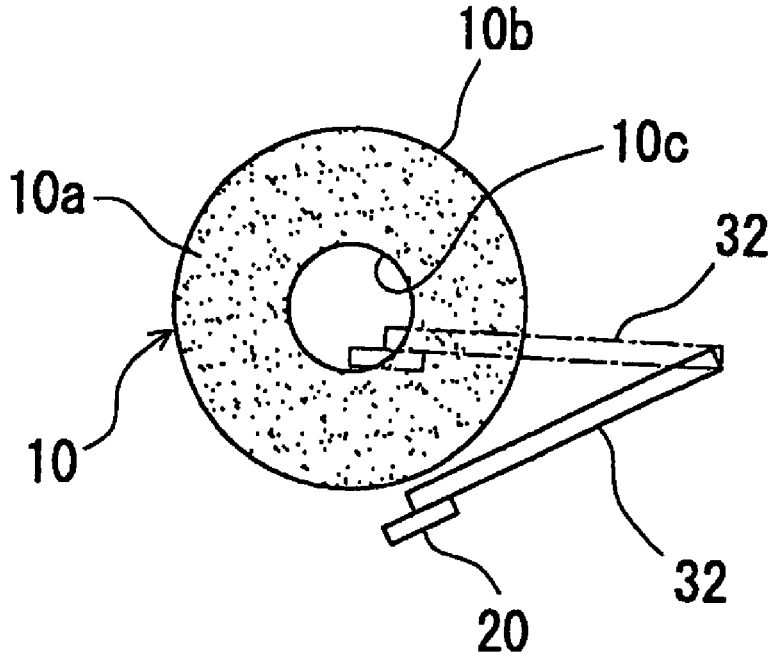
FIG. 4 is a schematic plan view showing traversing operation of electro-discharge truing electrode in the truing device, in which FIG. 4(*a*) shows an oscillating traversing operation of electro-discharge truing electrode by the electro-discharge truing electrode drive unit, and FIG. 4(*b*) shows a backward traversing operation of electro-discharge truing electrode by other electro-discharge truing electrode drive unit.
Figure 4B:
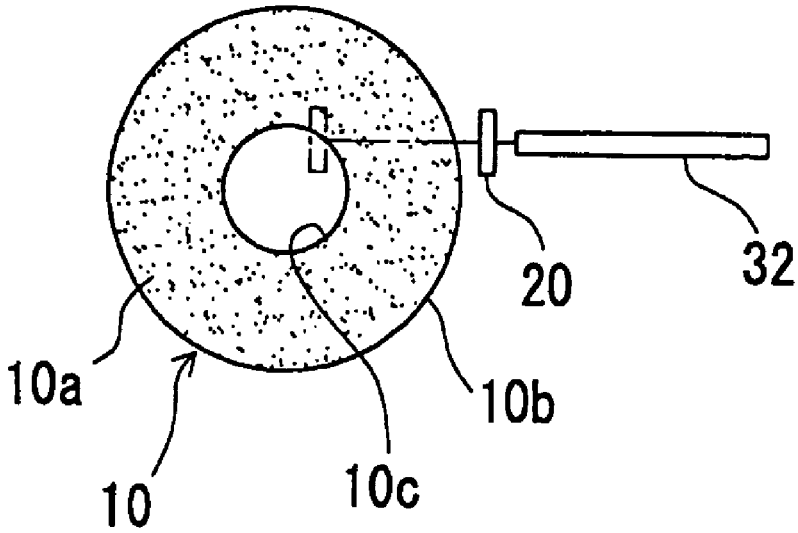

The truing electrode drive device 22 is a device for traversing the electro-discharge truing electrode 20 parallel along the grindstone surface 10*a* of the grindstone 10 as shown in FIG. 4(*a*), and it specifically has a structure as shown in FIG. 2 and FIG. 3, and the electro-discharge truing electrode 20 is traversed in a range including the outermost peripheral edge 10*b* and innermost peripheral edge 10*c* of the annular grindstone surface 10*a*.

The truing electrode drive device 22 mainly comprises, as shown in FIG. 2, a platform 30, an oscillating table 31 oscillatably disposed on the platform 30 by way of an oscillating mechanism not shown, and an arm member 32 fixed on the oscillating table 31.

At the leading end of the arm member 32, a rotary shaft 33 of the electro-discharge truing electrode 20 is rotatably supported through bearings 34, 34, and the rotary shaft 33 is linked to an electrode rotary drive device 36 through a power transmission mechanism 35 described below, so that the electro-discharge truing electrode 20 can be driven by rotation.

The electrode rotary drive device 36 specifically has a motor 37 fixed on the oscillating table 31, and a drive shaft 38 is linked to the rotary shaft (not shown) of the motor 37. The drive shaft 38 rotatably supported at the base end side of the arm member 32 through bearings 39, 39. The drive shaft 38 and rotary shaft 33 of the electro-discharge truing electrode 20 are mutually linked by way of the power transmission mechanism 35. The power transmission mechanism 35 is composed of transmission pulleys 35*a*, 35*b* fixed on both shafts 33, 38, and a transmission belt 35*c* for linking these transmission pulleys 35*a*, 35*b*.

At one end of the rotary shaft 33, a current feeder 37 is provided for connecting to the (−) electrode of the direct-current power supply device 12, and a voltage of (−) can be applied to the electro-discharge truing electrode 20. Accordingly, as the bearing 34 of the rotary shaft 33, preferably, a ceramic bearing is used from the viewpoint of prevention of current leak.

Moreover, the truing electrode drive device 22 also incorporates a coolant supply device (coolant supplying means) 40 for injecting coolant for cooling the electro-discharge truing electrode 20 at the time of electro-discharge truing operation described below, and an air supply device (air supplying means) 41 as coolant removing device for injecting air for removing the coolant deposits from the electro-discharge truing electrode 20.

The coolant supply device 40 includes a coolant supply source not shown, a coolant injection port 40*a* disposed oppositely to the inner side of the electro-discharge truing electrode 20 at the leading end of the arm member 32, and a piping 40*b* for coolant supply connecting them. A pressurized coolant supplied from the coolant supply source is injected to the inner side of the electro-discharge truing electrode 20 from the coolant injection port 40*a* by way of the piping 40*b*.

The air supply device 41 is for removing the coolant blown to the electro-discharge truing electrode 20 by air injection, and it is specifically composed of an air supply source not shown, an air injection nozzle 41*a* disposed oppositely to the cylindrical electrode surface 20*a* of the electro-discharge truing nozzle 20 at the leading end of the arm member 32, and a piping 41*b* for air injection supply for connecting them. A pressurized air supplied from the air supply source is injected to the cylindrical electrode surface 20*a* of the electro-discharge truing electrode 20 from the leading end of the air injection nozzle 41*a* through the piping 41*b*, and the coolant deposits are removed from the cylindrical electrode surface 20*a*.

By removing the coolant blown to the electro-discharge truing electrode 20 by the coolant supply device 40, an electrical insulation is assured between the cylindrical electrode surface 20*a* of the electro-discharge truing electrode 20 and the annular grindstone surface 10*a* of the grindstone 10.

In this preferred embodiment, since the grinding machine 1 is a vertical double disk surface grinding machine, the number of air injection nozzles 41*a* corresponds to the number of grinding wheels 2, 3, and hence a pair of upper and lower nozzles are disposed at the side of the arm member 32 as shown in FIG. 2. Besides, since the air injection nozzle 41*a* is provided in order to assure an electrical insulation between the electro-discharge truing electrode 20 and grindstone 10, it is installed so that the air injection direction of the nozzle leading end can be adjusted so as to inject the air into the gap of them (see double dot chain line in FIG. 2). Further, the leading end of the air injection nozzle 41*a* is disposed slightly eccentric to the outside from the center of the cylindrical electrode surface 20*a* as shown in FIG. 3 so as not to disturb blowing of the coolant injected from the coolant injection port 40*a* to the inner side of the electro-discharge truing electrode 20.

The control device 9 is a control center for controlling the operation of the components of the surface grinding machine 1, and is specifically composed of a microcomputer storing specified control programs.

That is, this control device 9 controls the operation of the grinding wheel rotary drive devices 4, 5 and grinding wheel infeed drive devices 6,7 of the grinding wheels 2, 3, current feeding device 21 of electro-discharge truing device 8, truing electrode drive device 22, and electrode rotary drive device 36 mutually and synchronously, and is hence capable of controlling the revolutions (rotating speed) and infeed of grinding wheels 2, 3, the traverse move (moving direction and moving speed) of the electro-discharge truing electrode 20, application of voltage to the electro-discharge truing electrode 20, and pressurizing operation of the coolant supply source and air supply source, in mutual relationship.

In the surface grinding machine 1 having such configuration, when truing the grinding wheels 2, 3, the control device 9 controls the grinding wheels 2, 3 and electro-discharge truing electrode 20 as follows, so that on-machine electro-discharge truing of grinding wheel 2 is realized.

A. Principle and Basic Operation of Electro-Discharge Truing upon start of electro-discharge truing, the control device 9 sets the gap of the upper and lower grinding wheels 2, 3 and the rotating speed of the grinding wheel 2, 3 as specified, and rotates and drives the electro-discharge truing electrode 20 at specified speed.

Parallel to these processes, the control device 9 turns on the power source of the direct-current power supply device 12, and applies a specified voltage to the grinding wheels 2, 3 and electro-discharge truing electrode 20.

Upon completion of these processes, the control device 9 operates the oscillating mechanism of the oscillating table 31, and traverses the electro-discharge truing electrode 20 from the outermost peripheral edge 10*b* side of the annular grindstone surface 10*a* to the innermost peripheral edge 10*c* side (see FIG. 4(*a*)).

At this time, a voltage of (+) is applied to the grindstone surfaces 10*a*, 10*a* of the grinding wheels 2, 3, and a voltage of (−) is applied to the electro-discharge truing electrode 20, and hence as the electro-discharge truing electrode 20 advances, an electro-discharge action occurs between the both electrodes, and thereby, as shown in FIG. 9(*a*), the metal bond B portion of the grindstone 10 is melted and removed, and an annular grindstone surface 10*a* is newly formed.

In the illustrated preferred embodiment, the coolant injected from the coolant injection port 40*a* of the coolant supply device 40 is atomized by the air injection from the air injection nozzle 41*a* of the air supply device 41, and the mist exists between the annular grindstone surface 10*a* and electro-discharge truing electrode 20, thereby increasing the electro-discharge effect.

Figure 10A:
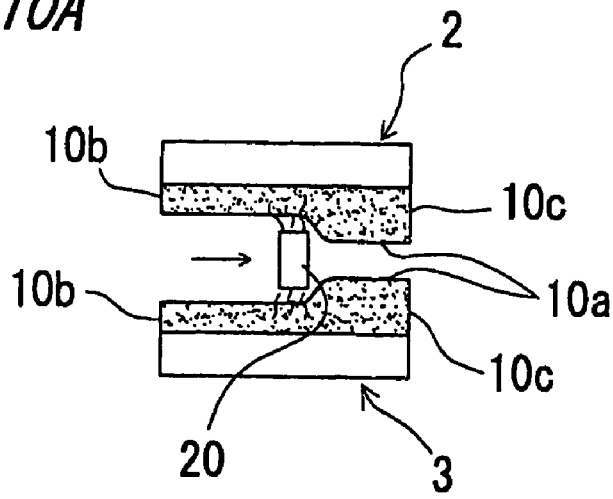
FIG. 10(*a*) to (*c*) are model diagrams showing time course changes of each process in the truing operation.
Figure 10B:
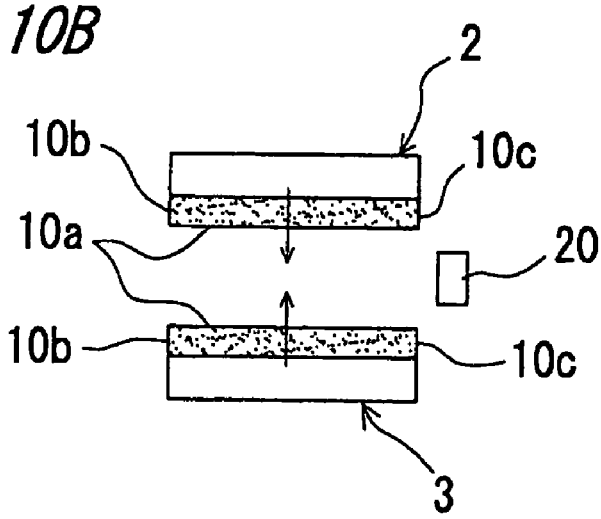
Figure 10C:
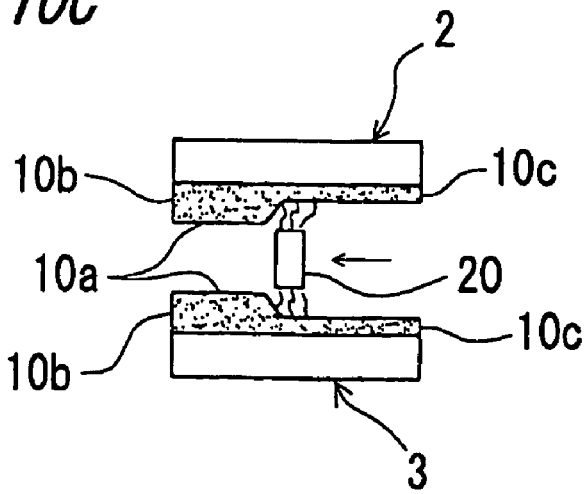

The forming process of the annular grindstone surface 10*a* by this electro-discharge action is explained more specifically by referring to FIG. 10, and first the electro-discharge truing electrode 20 is traversed from the outermost peripheral edge 10*b* of the annular grindstone surface 10*a* to the innermost peripheral edge 10*c*, and the metal bond B is melted and removed from the surface of the annular grindstone surface 10*a* (see FIG. 10(*a*)).

By this traversing motion, when the electro-discharge truing electrode 20 reaches the innermost peripheral edge 10*c* of the annular grindstone surface 10*a* (see FIG. 10(*b*)), this time, an infeed action is applied to the grinding wheels 2, 3 and the electro-discharge truing electrode 20 is traversed again toward the outermost peripheral edge 10*b* (see FIG. 10(*c*)).

The traversing motion of the electro-discharge truing electrode 20 and infeed operation of the grinding wheels 2, 3 are repeated sequentially until the annular grindstone surface 10*a* is formed in a specified shape.

Thus, in the double disk surface grinding machine 1 of the preferred embodiment, in truing operation of the grinding wheels 2, 3 since the annular grindstone surface 10*a* is trued without making contact by the electro-discharge truing technique, the grinding wheels can be trued in a short time without spoiling the edge of abrasive grains of the grindstones, and also in truing operation of double disk surface grinding machine, high precision truing is realized without deflection of arm member 32 as shown in FIG. 9(*b*).

B. Speed Control of Traversing Motion

In the surface grinding machine 1 of the preferred embodiment as described above, in truing operation of grinding wheels 2, 3 while traversing the electro-discharge truing electrode 20 parallel along the annular grindstone surface 10*a* of the grinding wheels 2, 3, if the rotating speed of the grinding wheels 2, 3 is kept at a specific speed, only by traversing the electro-discharge truing electrode 20 at a specific speed, uniform truing is not realized because of difference in the peripheral speed in the inner and outer peripheral position of the annular grindstone surface 10*a*.

Therefore, in the surface grinding machine 1 of the preferred embodiment, the control device 9 controls the traversing speed as follows so that the peripheral speed of the annular grindstone surface 10*a* may be almost constant all the time against the electro-discharge truing electrode 20 during the traversing operation.

That is, in the preferred embodiment, since the traversing motion of the electro-discharge truing electrode 20 is realized by the rotary drive of the oscillating mechanism, the control device 9 controls to adjust the rotating speed of the oscillating mechanism, in synchronism with the traversing motion of the electro-discharge truing electrode 20, so as to slow down the traversing speed when the electro-discharge truing electrode 20 is positioned near the outer periphery of the annular grindstone surface 10*a*, or accelerate when located near the inner periphery of the annular grindstone surface 10*a*, thereby keeping constant the removal amount per unit area of the annular grindstone surface 10*a* opposite to the electro-discharge truing electrode 20.

When controlling the traversing speed, the rotating speed of the oscillating mechanism is kept constant, and the rotating speed of the grinding wheel 2 may be adjusted in synchronism with the traversing motion of the electro-discharge truing electrode 20.

In short, the control device 9 controls and adjusts at least either one of the traversing speed of electro-discharge truing electrode 20 by the truing electrode drive device 22 or rotating speed of grinding wheels 2, 3 by the grinding wheel rotary drive devices 4, 5, and controls so that the peripheral speed of the annular grindstone surface may be constant against the electro-discharge truing electrode 20 in the traversing motion.

Thus, in the preferred embodiment, since the traversing speed of the electro-discharge truing electrode 20 or the rotating speed of the grinding wheels 2, 3 are controlled so as to keep constant the removal amount per unit area of the annular grindstone surfaces 10*a*, 10*b* opposite to the electro-discharge truing electrode 20 during traversing motion, the entire surface of the annular grindstone surfaces 10*a*, 10*a* may be trued uniformly.

Concerning the control of traversing speed, if the grinding wheels 2, 3 to be trued are deformed and the annular grindstone surfaces 10*a*, 10*a* are not flat, repeated traversing motions are needed to eliminate the undulations completely by control of the traversing speed only, and hence it is preferred to correct the control of traversing speed as follows by the control device 9.

That is, in this case, the direct-current power supply device 12 is provided with electro-discharge voltage detecting means (not shown) for detecting the electro-discharge voltage in electro-discharge truing operation, the electro-discharge voltage is detected, and the traversing speed is corrected according this electro-discharge voltage.

More specifically, when the grindstone surface 10*a* projects, the electro-discharge voltage is lower, and when the grindstone surface 10*a* sinks, the electro-discharge voltage is higher, and by detecting the electro-discharge voltage by the voltage detection sensor not shown, the result of detection is sent to the control device 9.

According to the result of detection, the control device 9 slows down the traversing speed when the grindstone surface 10*a* projects, and intensively removes the projecting portion of the metal bond B, or when the grindstone surface 10*a* sinks, the traversing speed is accelerated to decrease the removal amount of the metal bond B.

In order words, by correcting the traversing speed depending on undulations of the grindstone surfaces 10*a*, 10*a*, the number of repetitions of traversing motion of the electro-discharge truing electrode 20 can be decreased, so that truing may be realized in a short time.

C. Gap Control

To perform such electro-discharge truing of high precision, it is required to maintain a preset dimension of gap between the grindstone surfaces 10*a*, 10*a* of the grinding wheels 2, 3 and the electro-discharge truing electrode 20, and in this preferred embodiment the control device 9 is designed to control the grinding wheel infeed drive devices 6, 7 according to the electrical information of the electro-discharge position.

Figure 5:
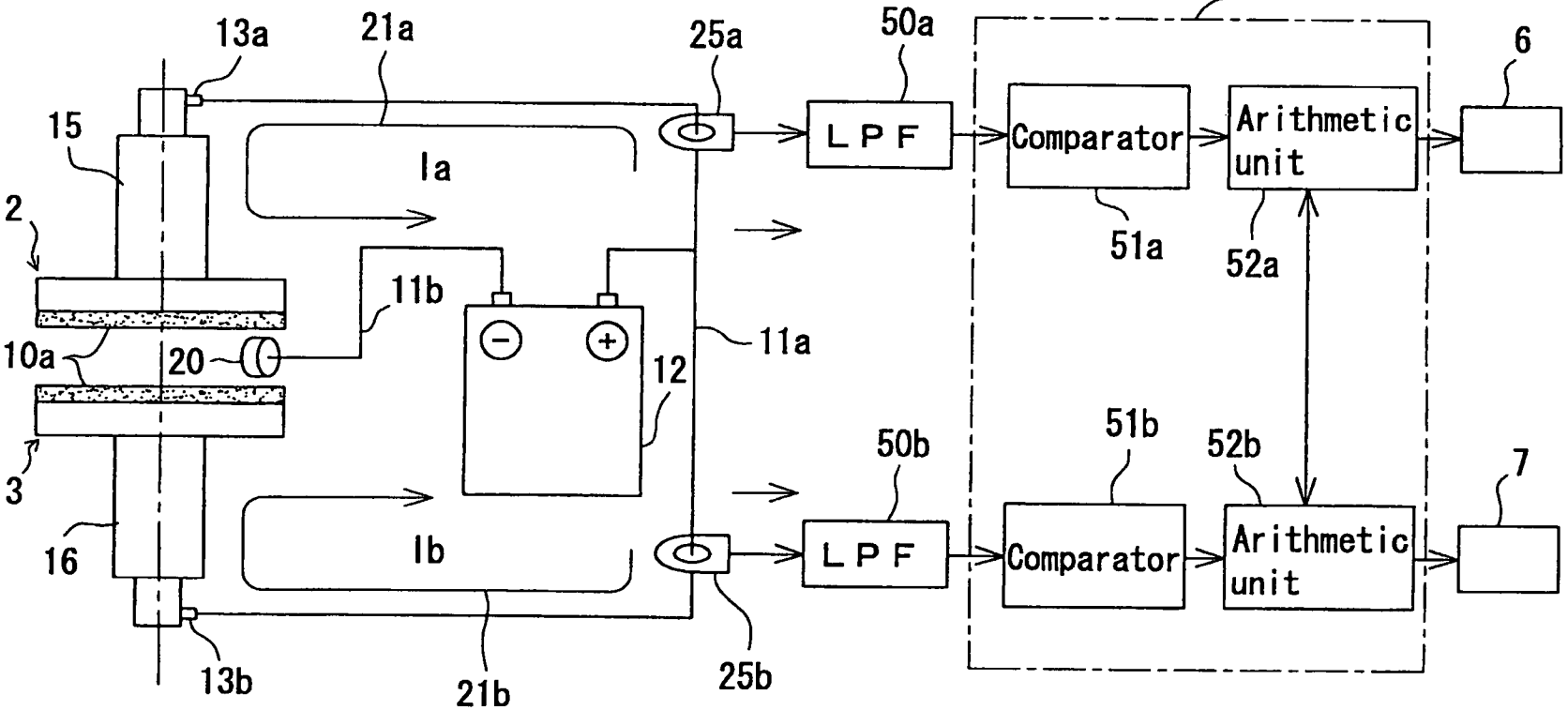
FIG. 5 is a block diagram of configuration of gap control system of electro-discharge truing in the grinding machine.

A configuration of the gap control system is shown in FIG. 5, and in the illustrated preferred embodiment, as the electrical information of the electro-discharge position, the current flowing in the current feeding circuits 21*a*, 21*b* is utilized. Although not shown in the drawing, the electro-discharge voltage at the electro-discharge position detected by a voltage detection sensor (not shown) may be also used as the electrical information of the electro-discharge position.

That is, in the gap control system shown in FIG. 5, the currents Ia, Ib flowing in the current feeding circuits 21*a*, 21*b* are detected by current detection sensors 25*a*, 25*b*, and the detected currents Ia, Ib are sent into current waveform shaping units 50*a*, 50*b* for removing noise and supplied into the control device 9. In the control device 9, comparators 51*a*, 51*b* compare the detected currents Ia, Ib with preset value, and send the result of comparison to arithmetic units 52*a*, 52*b*. The arithmetic units 52*a*, 52*b* calculate correction amounts necessary for the grinding wheels 2, 3 from the result of comparison (the infeed necessary for obtaining the optimum gap (target value)), and the correction amounts are adjusted to equalize the gap of the both upper and lower grinding wheels 2, 3, and corresponding control signals are sent to the grinding wheel infeed drive devices 6, 7 of the upper and lower grinding wheels 2, 3.

In the preferred embodiment, the set value is determined in two stages, and set value 1 is the upper limit (for example, 10 A) of allowable current of the gap necessary for electro-discharge truing, and set value 2 is the lower limit (for example, 8 A).

Figure 6:
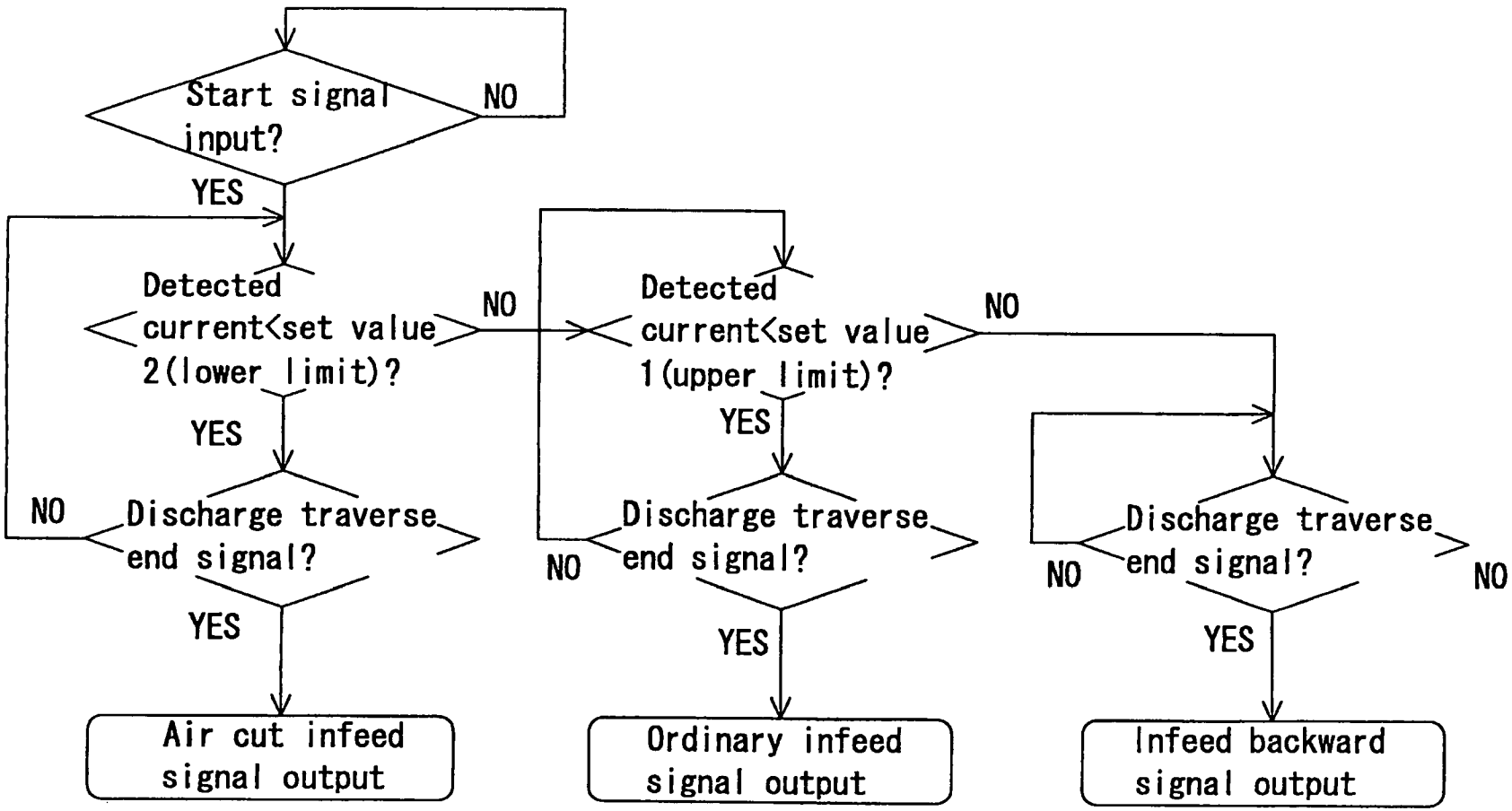
FIG. 6 is a flowchart showing the control process in the gap control system.

In this gap control system, the gap of the upper and lower grinding wheels 2, 3 is controlled as follows (see flowchart in FIG. 6).

In the basic motion (traversing motion) of electro-discharge truing mentioned above, when the electro-discharge truing electrode 20 moves to the traverse position capable of discharging between the grindstone surfaces 10*a*, 10*a* of the grinding wheels 2, 3, an electro-discharge start signal is fed, and electro-discharge truing of the upper and lower grinding wheels 2, 3 is started at the same time.

During electro-discharge truing operation, the currents Ia, Ib flowing in the current feeding circuits 21*a*, 21*b* are always detected by the current detection sensors 25*a*, 25*b*, and the detected currents Ia, Ib are compared with set values 1, 2 by the comparators 51*a*, 51*b*, and depending on the result of comparison, the arithmetic units 52*a*, 52*b* calculate and adjust the necessary correction values.

When the electro-discharge truing electrode 20 moves to a traverse position incapable of discharging between the grindstone surfaces 10*a*, 10*a* of the grinding wheels 2, 3, an electro-discharge end signal is fed, and electro-discharge truing of the upper and lower grinding wheels 2, 3 is stopped at the same time, and control signals corresponding to the result of calculation are sent from the arithmetic units 52*a*, 52*b* to the grinding wheel infeed drive devices 6, 7 of the upper and lower grinding wheels 2, 3.

As a result, the grinding wheel infeed drive devices 6, 7 move the grinding wheels 2, 3 by the required infeed amount according to the control signals, and the gap between the grinding wheels 2, 3 is adjusted to the target value.

Specifically, (i) when the maximum detection current during traversing, that is, the maximum value of the currents Ia, Ib detected during traversing is larger than the set value 1, a backward signal is sent as control signal to the grinding wheel infeed drive devices 6, 7, and upon completion of traversing motion, the grinding wheels 2, 3 are moved back (returned) by a preset amount (for example, 2 μm). Or, (ii) when the maximum detected currents Ia, Ib during traversing are smaller than the set value 1 but larger than the set value 2, an OK signal is sent as control signal to the grinding wheel infeed drive devices 6, 7, and upon completion of traversing motion, the grinding wheels 2, 3 are moved forward (infeed) by a preset amount (for example, 1 μm (worn portion of grindstone)) (ordinary infeed). Further, (iii) when the maximum detected currents Ia, Ib during traversing are smaller than the set value 2, a forward signal is sent as control signal to the grinding wheel infeed drive devices 6, 7, and upon completion of traversing motion, the grinding wheels 2, 3 are moved forward (infeed) by a preset amount (for example, 4 μm) (air cut correction).

In the gap control system of the preferred embodiment, as the electrical information of the electro-discharge position, the currents flowing in the upper and lower current feeding circuits 21*a*, 21*b* are utilized owing to the following reason.

Figure 8:
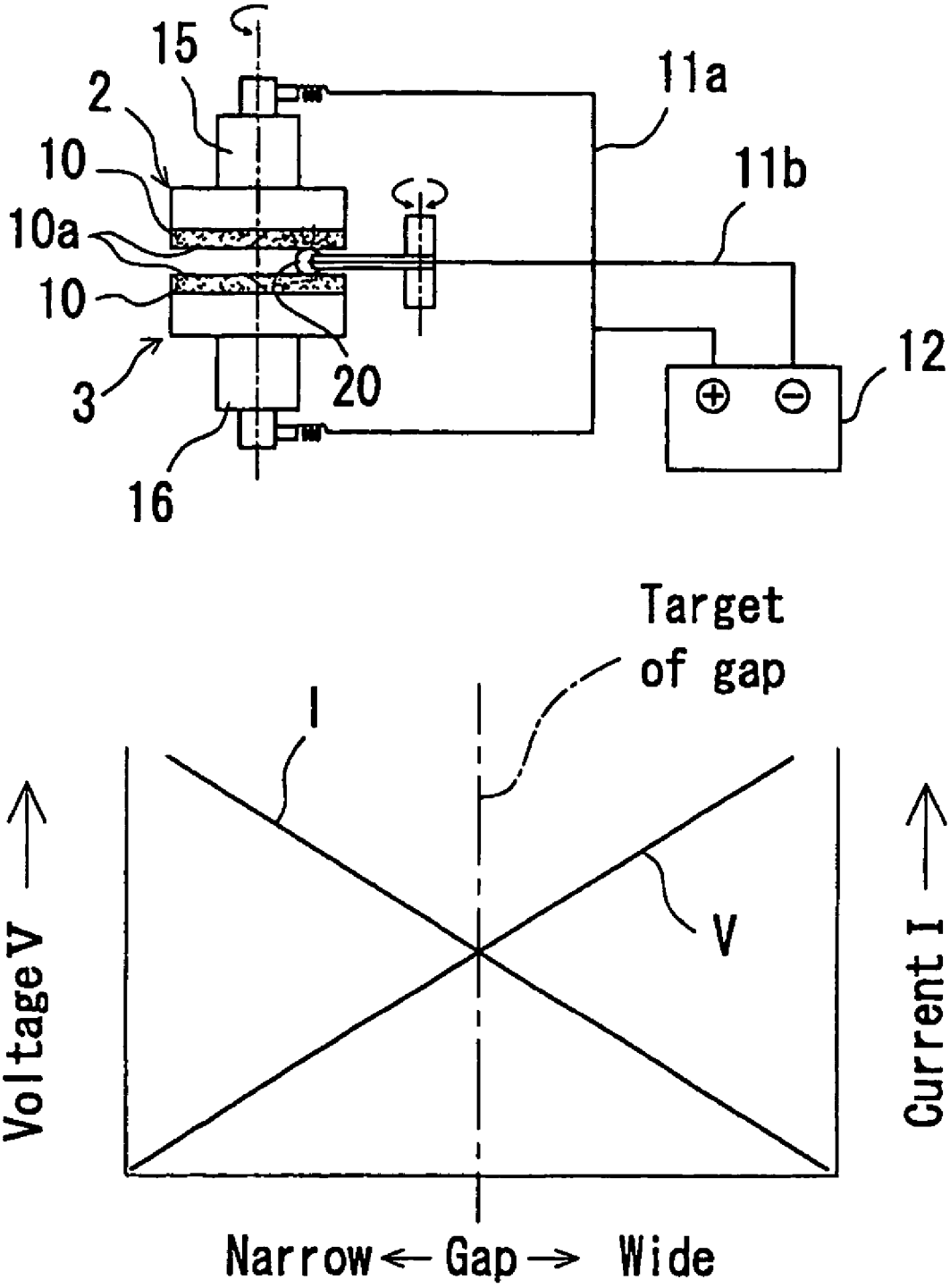
FIG. 8 is a diagram explaining the principle of gap control of upper and lower grinding wheels in other gap control system making use of supply voltage, in which FIG. 8(*a*) is a schematic structural diagram showing the system, and FIG. 8(*b*) is a diagram showing the relation between a supply voltage characteristic and a current characteristic flowing in each current feeding circuit of upper and lower grinding wheels in this system.

That is, as shown in FIG. 8, in the case of electro-discharge truing of one side only, for example, the upper grinding wheel 2, its gap is controlled by maintaining the voltage determined by the voltage V declining in inverse proportion to the current I as shown in FIG. 8(*b*).

In such gap control system, when the both upper and lower grinding wheels 2, 3 are trued at the same time, for example, if the gap between the electro-discharge truing electrode 20 and upper grinding wheel 2 is large and the gap to the lower grinding wheel 3 is small, the current amount of the upper current feeding circuit 21*a* is small and the current amount of the lower current feeding circuit 21*b* is large, but the change of supply voltage that can be detected by the voltage detection sensor (not shown) in the direct-current power supply device 12 is the change of voltage V due to combined current of the upper current feeding circuit 21*a* and lower current feeding circuit 21*b*, and when the gap of the grinding wheels 2, 3 cannot be controlled.

Figure 7A:
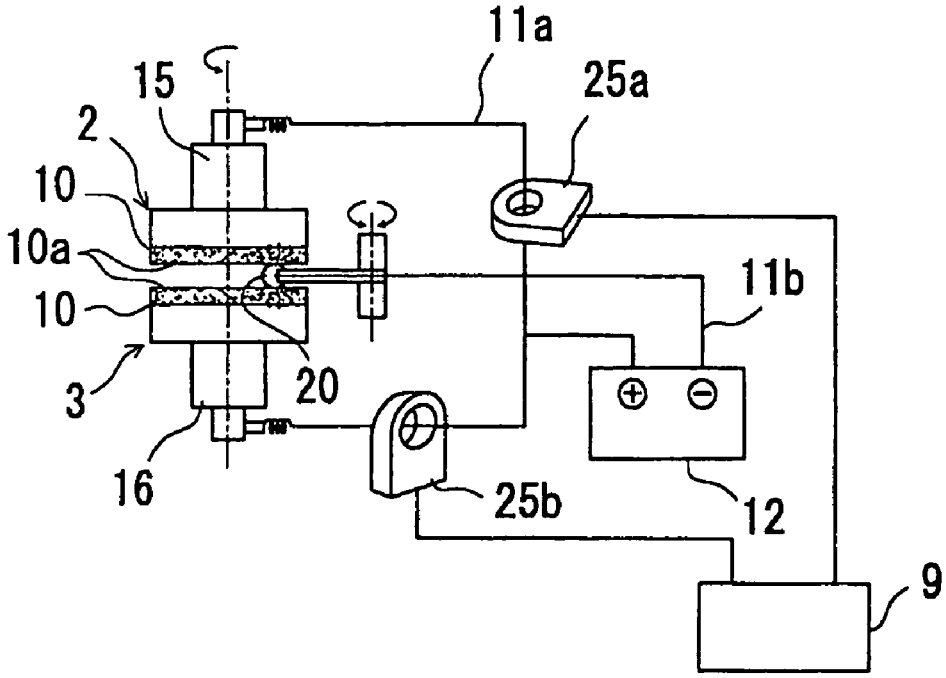
FIG. 7 is a diagram explaining the principle of gap control of upper and lower grinding wheels in the gap control system, in which FIG. 7(*a*) is a schematic structural diagram showing the system, and FIG. 7(*b*) is a diagram showing a current characteristic flowing in each current feeding circuit of upper and lower grinding wheels in this system.
Figure 7B:
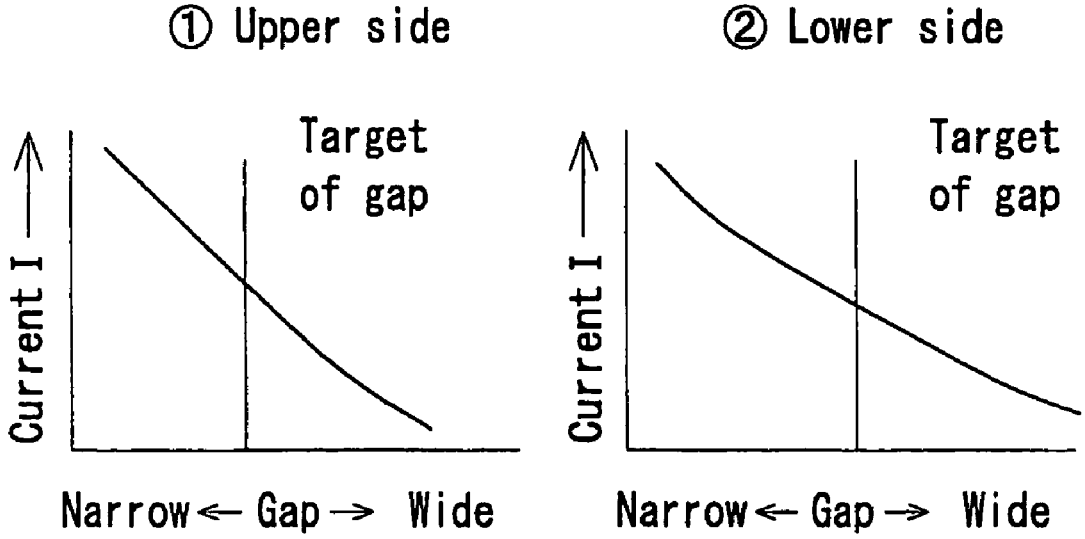

Accordingly, in the preferred embodiment, by employing the system shown in FIG. 7 as mentioned above, by the electro-discharge truing device 8 having one direct-current power supply device 12, if the grindstone surfaces 10*a*, 10*a* of the upper and lower grinding wheels 2, 3 are trued at a time, the gap can be controlled in both grinding wheels 2, 3. Although not shown specifically, if the electro-discharge voltage of the electro-discharge position is utilized as the electrical information of the electro-discharge position, the gap can be similarly controlled as mentioned above.

Thus, in the preferred embodiment, by controlling the gap of the grinding wheels 2, 3 by using the currents flowing in the current feeding circuits 21*a*, 21*b* of the grindstone surfaces 10*a*, 10*a*, when the pair of mutually opposite grinding wheels 2, 3 are trued at the same time by the single electro-discharge truing device 8, the gap can be controlled at high precision between the grindstone surfaces 10*a*, 10*a* of the grinding wheels 2, 3.

The preferred embodiment shows a preferred embodiment of the invention, but the invention is not limited to this preferred embodiment alone, but the design can be changed or modified within the scope, and examples are given below.

Figure 11A:
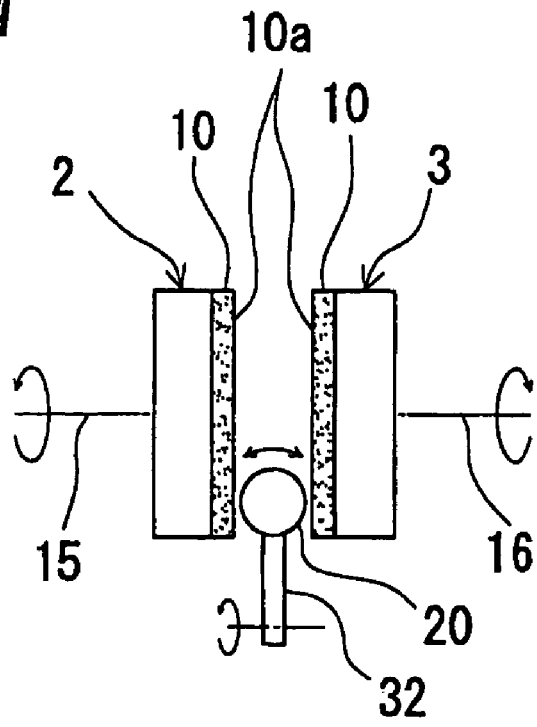
FIG. 11 shows other example of application of electro-discharge truing of the invention, in which FIG. 11(*a*) shows a case of application in horizontal double disk surface grinding machine, and FIG. 11(*b*) shows a case of application in vertical single disk surface grinding machine.
Figure 11B:
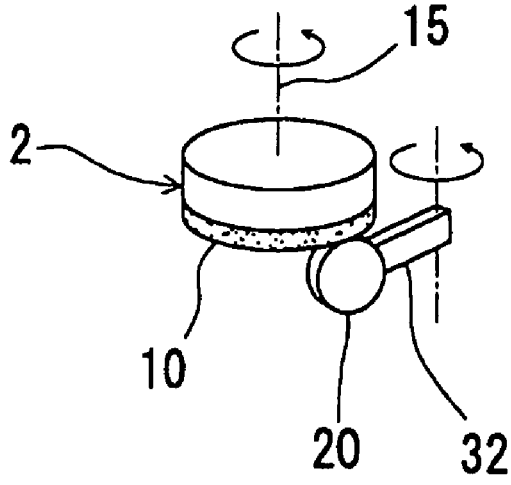

(1) In the illustrated preferred embodiment, the invention is applied in the vertical double disk surface grinding machine, but it can be also applied in a horizontal double disk surface grinding machine as shown in FIG. 11(*a*), or not limited to the double disk surface grinding machine, it can be also applied in a single disk surface grinding machine as shown in FIG. 11(*b*). In other words, the invention can be applied in surface grinding machines of any type as far as electro-discharge truing is executed by traversing the electro-discharge truing electrode 20 relatively along the annular grindstone surface 10*a* of the surface grinding machine 1.

In this case, in the single disk surface grinding machine in FIG. 11(*b*), as the electrical information of electro-discharge position for gap control of the grindstone surface 10*a* by the control device 8, as explained in FIG. 8, the supply voltage detected by the voltage detection sensor in the direct-current power supply device 12 can be utilized.

(2) In the illustrated preferred embodiment, a rotary electrode driven by rotation is shown as the electro-discharge truing electrode 20, but the electro-discharge truing electrode may be also realized by the fixed electrode not driven by rotation.

(3) In the illustrated preferred embodiment, when traversing the electro-discharge truing electrode 20, the structure for oscillating the arm member 32 is used, but as shown in FIG. 4(*b*), for example, it may be also realized by a structure of electrode forward and backward moving mechanism for moving the electro-discharge truing electrode 20 forward or backward parallel to the grindstone surface 10*a* by moving in or out the arm member 32.

(4) In the illustrated preferred embodiment, when traversing the electro-discharge truing electrode 20, sliding motion of the electro-discharge truing electrode 20 is shown, but the electro-discharge truing may be also executed by sliding the grinding wheel 2.

Figure 12:
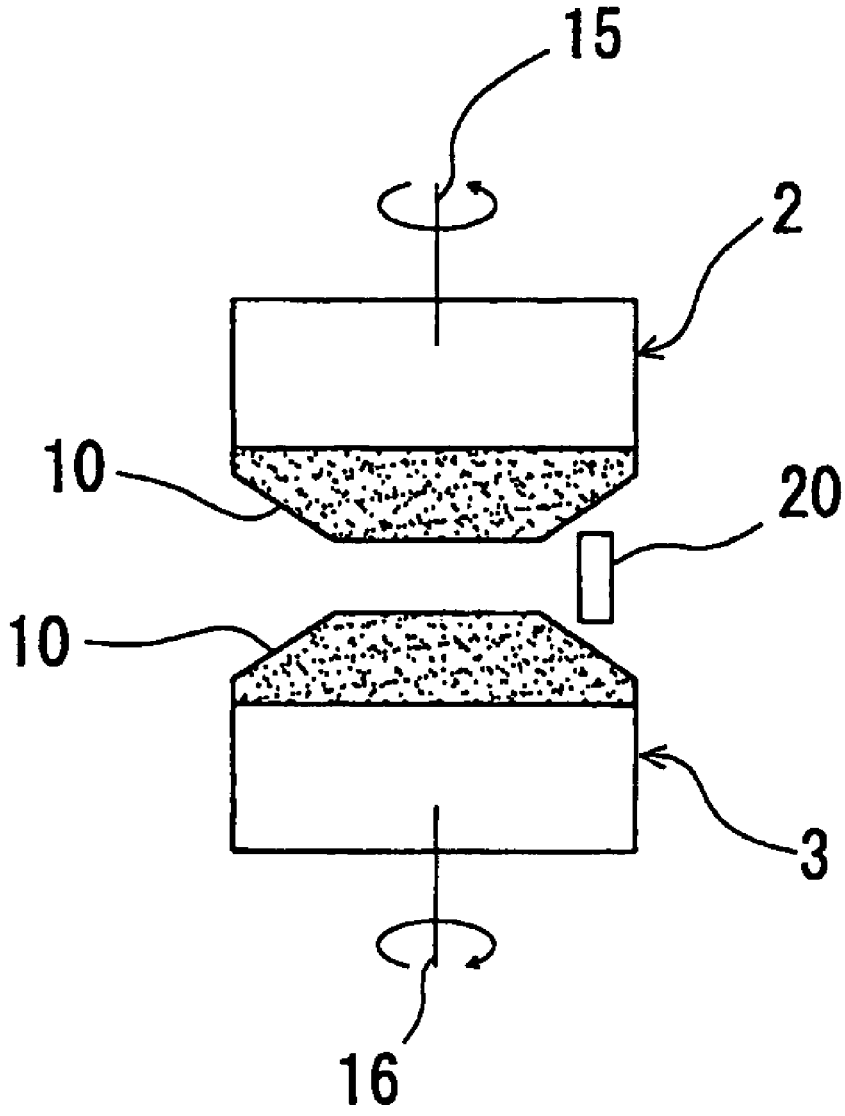
FIG. 12 is a schematic side sectional view showing other example of grindstone of grinding wheel truing by other electro-discharge truing by the vertical double disk surface grinding machine.

(5) In the illustrated preferred embodiment, the annular grindstone surfaces 10*a* of the grinding wheels 2, 3 are flat, but a truing profile as shown in FIG. 12, for example, is also possible by changing the infeed of the grinding wheel 2 in synchronism with the traversing motion of the electro-discharge truing electrode 20.

Figure 13:
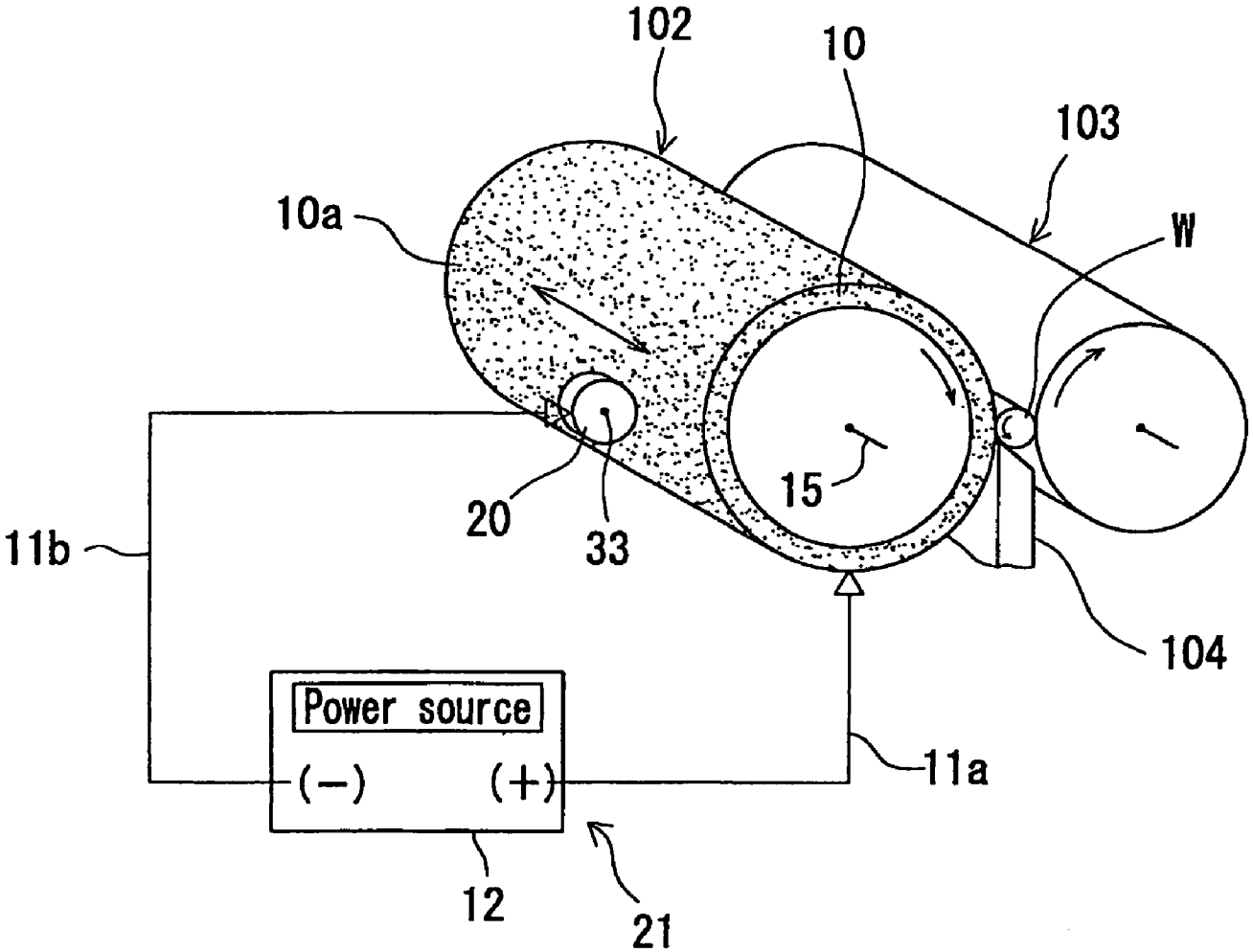
FIG. 13 is a schematic perspective view showing a case of application of electro-discharge truing of the invention in a centerless grinding machine.
Figure 14A:
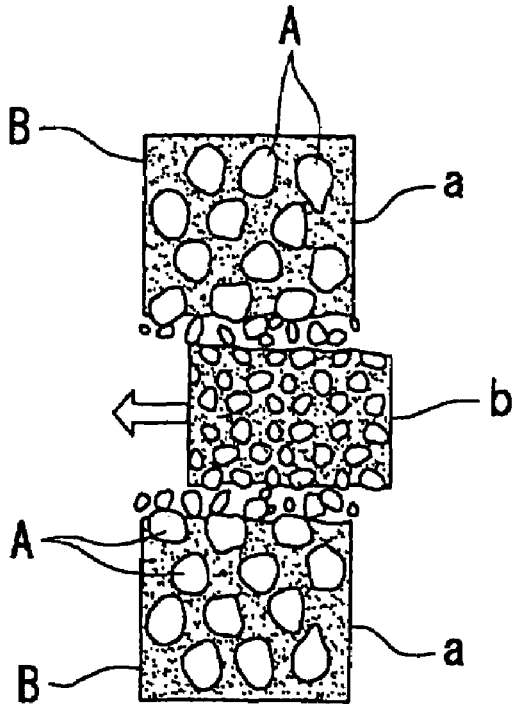
FIG. 14 is an explanatory diagram for explaining a truing method by using a dressing stone in a conventional vertical double disk surface grinding machine, in which FIG. 14(*a*) is a magnified view of grindstone of grinding wheel at the time of truing, and FIG. 14(*b*) shows an arm member for supporting the dressing stone at the time of truing.
Figure 14B:
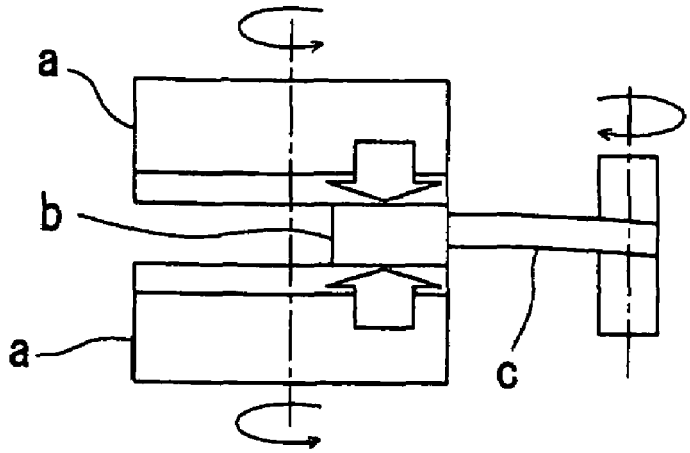

(6) The invention may be also applied in a centerless grinding machine as shown in FIG. 13, and in this case, same as in the case of the single head surface grinding machine in FIG. 11(*b*), as the electrical information of electro-discharge position for gap control by the control device 8 of the cylindrical grindstone surface 10*a* in a cylindrical grinding wheel 102, the supply voltage detected by the voltage detection sensor in the direct-current power supply device 12 can be utilized as explained in FIG. 8.

In FIG. 13, reference numeral 103 shows an adjusting wheel, and 104 is a blade for supporting a work W.

(7) Further the invention may be applied, although not shown, in various other grinding machines such as cylindrical grinding machine and inter (internal grinding) reciprocating surface grinding machine.

INDUSTRIAL APPLICABILITY

As described herein, according to the invention, when truing the conductive grinding wheels, since electro-discharge truing is executed while traversing the position of the electro-discharge truing electrode relatively to the grindstone surface of grinding wheel of the grinding machine, the required time for truing is substantially shortened as compare with the truing operation by the conventional lapping technique.

Moreover, since the electro-discharge truing electrode and annular grindstone surface do not contact with each other in truing operation, the edges of the abrasive grains of the grindstone are not worn, and sharpness of abrasive grains remains unchanged, so that truing of high precision is realized. In particular, in truing of double disk grinding machine, distortion due to deflection of the conventional arm is eliminated, and truing of higher precision is possible, and two grinding wheels can be trued at a time by one truing operation, and the working time is shortened notably.

Further, the gap control of the dimension between the grindstone surface of the grinding wheel and the electro-discharge truing electrode can be done by making use of the electrical information of the electro-discharge position, and in the double disk surface grinding machine, in particular, since the currents flowing in the current feeding circuits of the grindstone surface are utilized as the electrical information of the electro-discharge position, when truing a pair of mutually opposite grinding wheels simultaneously by one truing means, gap control of high precision is possible between the grindstone surfaces of grinding wheels and the electro-discharge truing electrode.

The invention claimed is:

1. A method for truing one or more grindstones of grinding wheels in a grinding machine operative for grinding a work by rotating one or more grinding wheels, wherein each grinding wheel is composed of a conductive grindstone having abrasive grains bound by a conductive binding material and has a grindstone surface, wherein an electro-discharge truing electrode disposed oppositely to one or more grindstone surfaces of the conductive grindstones is traversed relatively along the grindstone surfaces, and the grindstone surfaces are trued by electro-discharge action, and wherein a gap between each of the grindstone surfaces of the conductive grindstones and the electro-discharge truing electrode is controlled according to electrical information at one or more electro-discharge positions, and wherein the grinding machine comprises a controlling means for (1) controlling and adjusting the traversing speed of the electro-discharge truing electrode and the rotational speed of the grinding wheels to uniformly true the grindstone surfaces and eliminate undulations in the grindstone surfaces, and (2) maintaining a preset dimension of the gap between each of the grindstone surfaces and the electro-discharge truing electrode according to the electrical information at said one or more electro-discharge positions.

2. The method for truing one or more grindstones of grinding wheels of claim 1, wherein the gap between each of the grindstone surfaces of the conductive grindstones and the electro-discharge truing electrode is controlled according to the electrical information at one or more electro-discharge position detected during a traversing motion and upon completion of the traversing motion of the electro-discharge truing electrode.

3. The method for truing one or more grindstones of grinding wheels of claim 2, wherein the electrical information at one or more electro-discharge positions is the current flowing in a current feeding circuit.

4. The method for truing one or more grindstones of grinding wheels of claim 2, wherein the electrical information at one or more electro-discharge positions is an electro-discharge voltage at said one or more electro-discharge position.

5. The method for truing one or more grindstones of grinding wheels of claim 1, wherein each of said grinding wheels has a flat annular grindstone surface, and wherein the electro-discharge truing electrode is traversed along each of the annular grindstone surfaces in a range including the outermost peripheral edge and innermost peripheral edge of each of the annular grindstone surfaces.

6. The method for truing one or more grindstones of grinding wheels of claim 5, wherein a peripheral speed of the annular grindstone surfaces opposite to the electro-discharge truing electrode during traversing motion is kept constant by adjusting at least either the traversing speed of the electro-discharge truing electrode or the rotating speed of each of said grinding wheels.

7. The method for truing one or more grindstones of grinding wheels of claim 1, wherein said grinding wheel has a cylindrical grindstone surface, and wherein the electro-discharge truing electrode traverses parallel along the cylindrical grindstone surface from one end to an opposing end as viewed in an axial direction of the cylindrical grindstone surface.

8. The method for truing one or more grindstones of grinding wheels of claim 1, wherein the grindstone surfaces and grindstones of grinding wheels total one or two.

* * * * *